United States Patent [19]

Klemic, Jr.

[11] Patent Number: 4,872,298

[45] Date of Patent: Oct. 10, 1989

[54] CONCRETE ANCHOR BOLT SETTING DEVICE

[76] Inventor: Frank Klemic, Jr., 11225 Hannum Ave., Culver City, Calif. 90230

[21] Appl. No.: 155,586

[22] Filed: Feb. 12, 1988

[51] Int. Cl.[4] ..... E04B 1/20; E04B 1/41

[52] U.S. Cl. ..... 52/127.1; 52/295; 52/699; 52/701; 52/707

[58] Field of Search ..... 52/699, 700, 701, 702, 52/704, 705, 706, 127.1, 295

[56] References Cited

U.S. PATENT DOCUMENTS

| | | | |
|---|---|---|---|
| 1,072,361 | 9/1913 | Rickman | 52/699 |
| 1,078,007 | 11/1913 | Stange | 52/704 |
| 1,088,290 | 2/1914 | McAllister | 52/707 X |
| 1,365,718 | 1/1921 | Ogden | 52/701 |
| 1,503,148 | 7/1924 | Bernstrom | 52/699 X |
| 1,699,736 | 1/1929 | Hanna | 52/699 X |
| 2,687,788 | 8/1954 | Rapp | 52/704 X |
| 3,166,815 | 1/1965 | Rappas | 52/701 X |
| 3,391,514 | 7/1968 | Hall | 52/704 X |
| 3,405,497 | 10/1968 | McNair | 52/699 X |
| 3,854,371 | 12/1974 | Lamothe | 52/699 |
| 4,117,643 | 10/1978 | Lamothe | 52/699 |
| 4,118,910 | 10/1978 | McSherry | 52/704 X |
| 4,312,163 | 1/1982 | Leemhuis | 52/700 X |

FOREIGN PATENT DOCUMENTS

| | | | |
|---|---|---|---|
| 3021360 | 12/1981 | Fed. Rep. of Germany | 52/699 |
| 172961 | 10/1960 | Sweden | 52/701 |

*Primary Examiner*—John E. Murtagh

*Attorney, Agent, or Firm*—Cislo & Thomas

[57] ABSTRACT

An assemblage for setting an anchor in a mass of concrete is shown. It comprises an anchor and a setting bolt, which have mating threads. Once the anchor is set, other bolts can replace the setting bolt and then be used outside the wall for various purposes. For instances, with a bolt that extends outside the wall, the system can be used to erect a scaffold.

2 Claims, 2 Drawing Sheets

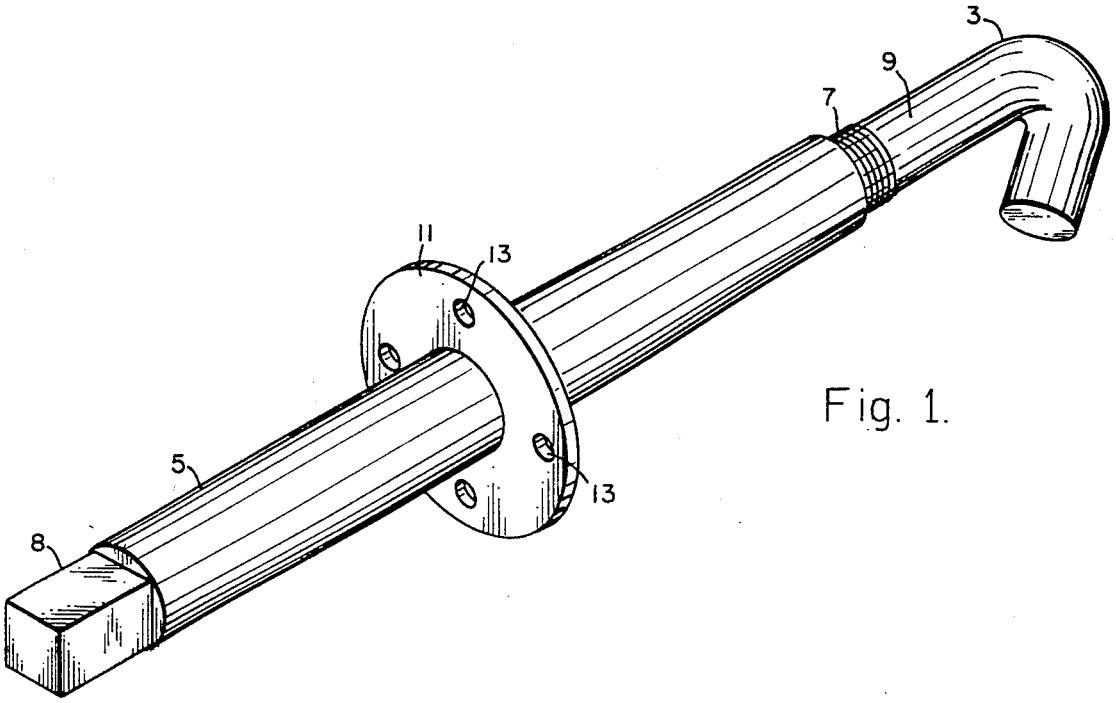
Fig. 1.
Fig. 2.
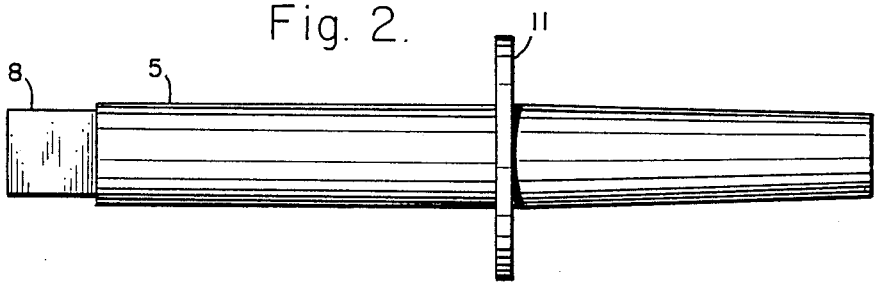
Fig. 3.
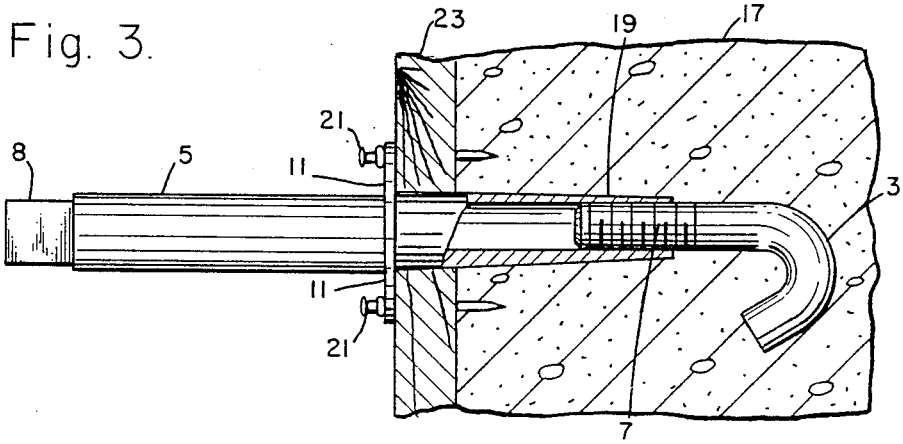

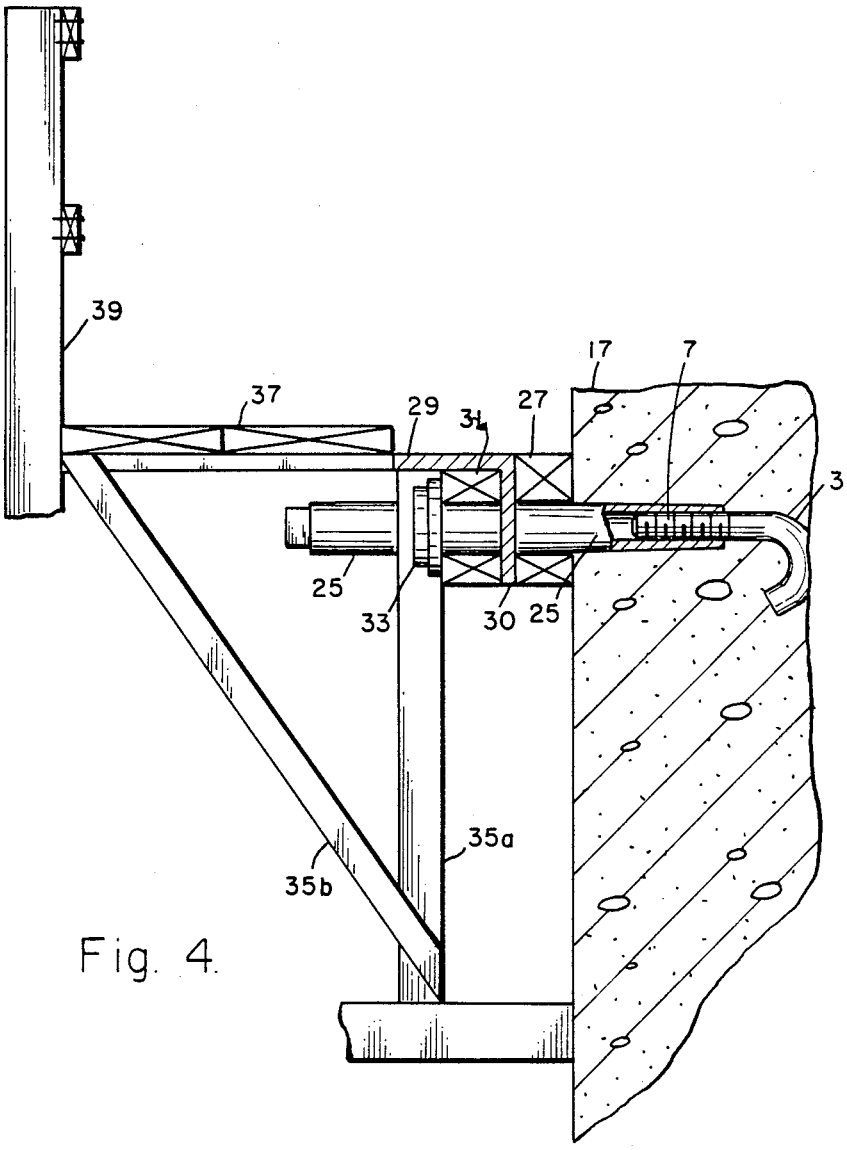
Fig. 4.
Fig. 5.
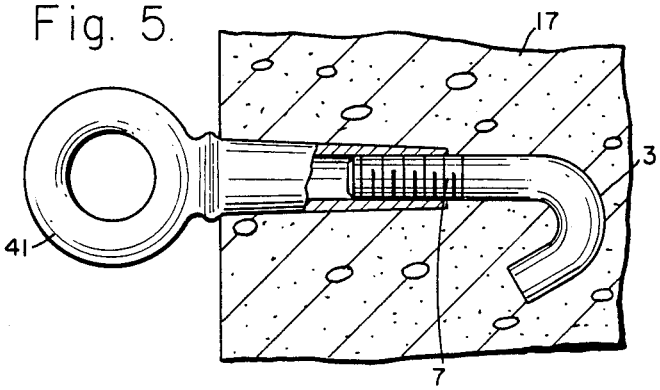

CONCRETE ANCHOR BOLT SETTING DEVICE

BACKGROUND

The prior art has disclosed various approaches for securing bolts in concrete. For example, U.S. Pat.No. 913,876 is directed to internally threaded sections gas pipes which are embedded in concrete so that a bolt may then be screwed into it.

U.S. Pat. No. 333,388 also uses a tubular body with internal threads. The body is embedded in cement to receive a threaded bolt which is used as an anchor for a wall plate or cap.

U.S. Pat. No. 3,993,341 utilizes a vertical bushing mounted on a horizontal plate for receiving a bolt for lifting a slab.

U.S. Pat. No. 4,117,643 is directed to a sleeve which is embedded in concrete. The sleeve has internal threads for receiving an anchor bolt.

OBJECTS AND SUMMARY OF THE INVENTION

It is an object of the present invention to provide a novel assemblage for setting anchor in a concrete structure.

It is a further object of the invention that those anchors should be set at a predetermined depth.

It is a further object of the invention that the anchor will be available for mating with setting bolts and other structures, such as scaffold supports and eye bolts that will protrude outside the concrete structure.

It is a further object of the invention to describe a method for using the anchor in connection with the erection of a scaffold to be used in constructing a building.

It is a further object of the invention to eliminate the need for a waler such as used in the present method of setting J-bolts, saving both time and material.

The present invention is directed to an assemblage for setting an anchor at a predetermined depth in a concrete form but under such conditions that it is available for use in connection with structures outside the concrete form. It is particularly useful in the formation of concrete walls for large structures. For example, it can be used most efficiently in setting scaffolding from which the upper levels of the frame can be erected so that concrete may be paired therein.

Because the anchor is fully embedded in concrete, it provides a strong base for attachment to it.

BRIEF DESCRIPTION OF THE DRAWINGS

FIG. 1 is a perspective view of the anchor setting assemblage;

FIG. 2 is a side elevational view of the setting bolt in FIG. 1;

FIG. 3 is a cross-section side view illustrating the assemblage in connection with a concrete slab and frame;

FIG. 4 illustrates a scaffolding arrangement in place using the concept of the present invention;

FIG. 5 illustrates another use of the present invention in which an eye-bolt is placed in position outside the concrete structure.

DETAILED DESCRIPTION OF THE PREFERRED EMBODIMENTS

With reference to the drawings, the same numbers will be used for the same parts throughout.

FIG. 1 shows an assemblage of the invention generally at 1. It consists of anchor 3 and setting bolt 5. Exterior threads 7 are partially shown on the longer arm 9 of anchor 3. A securing plate is illustrated as an annular disc 11 around the body of setting bolt 5. Annular disc 11 has holes 13 for nails or screws.

FIG. 2 is a side view of setting bolt 5.

FIG. 3 is a cross section through concrete block 17 showing anchor 3 embedded therein with exterior threads 7 on anchor 3 and interior threads 19 on the interior of setting bolt 5 in mating relationship. Nails 21 protrude through annular disc 11 and into wood frame 23.

FIG. 4 illustrates one use of the setting assemblage of the present invention. In this case, it is used in setting up a scaffold. In this illustration, wood frame 23 of FIG. 3 as well as setting bolt 5 of FIG. 3 have been removed, and a bolt 25 has been screwed into the exterior threads of anchor 3. Bolt 25 is similar to setting bolt 5 except that it does not have annular disc 11. Instead, spacer 27 is mounted on bolt 13 and brought flush with the side of concrete block 17. A right angle projection 30 of horizontal scaffold frame 29 is mounted on bolt 25 flush against spacer 27. Waler 31 is pushed against projection 30 of scaffold frame 29 and is held in place by cathead 33. Scaffolding jacks 35a and 35b, planks 37 and handrail 39 are put in place in a conventional manner and provide a safe working platform to receive and secure the next panel of the wood frame.

In FIG. 5 bolt 25 has been replaced by eye bolt 41 to illustrate another aspect of the invention. In this case, items can be secured to concrete block 17 through the eye of the eye bolt 41.

In the illustrated embodiment, anchor 3 is the male member of the assemblage and setting bolt 5 as well as bolt 25, are the female member. Obviously the relationship can be reversed.

Thus there has been disclosed an assemblage for setting an anchor in concrete and a method of utilizing that anchor once it has been placed. Various modifications and changes which are obvious will occur to the person skilled in the art, and all such changes and modifications are intended to be cover by the invention as defined by the dependent claims.

What is claimed is:

1. A device for setting an anchor in place in concrete having a surface comprising:

an anchor which is substantially J-shaped, one end of which is threaded on its exterior surface, and a setting bolt comprising a durable and tapered metal bar having a hollow end with internal threads which mate with the threads on the anchor, wherein said anchor is set entirely below the surface of the concrete and wherein said metal bar is partially set below the surface of the concrete where said bar engages said anchor, and means for securing said setting bolt to a first surface on one side of a frame having a second surface on an opposite side of the frame defining a form for pouring concrete, said setting bolt is partially inserted in a hole formed in said frame and mated with the anchor, wherein said means is defined by an annular plate fixedly coupled to said metal bar at a predetermined distance from said hollow end of said metal bar, said annular plate having a plurality of through openings formed therein for receiving fasteners to provide releasable coupling to said first surface of said frame, whereby said metal bar is removed to expose said threaded exterior surface of said anchor subsequent to solidification of said poured concrete.

2. The device of claim 1 wherein the J-shaped anchor has one arm longer than the other the anchor is threaded on the longer arm.

* * * * *